US007781705B2

(12) United States Patent
Weiss et al.

(10) Patent No.: US 7,781,705 B2
(45) Date of Patent: Aug. 24, 2010

(54) ELECTRICAL CONNECTION TO PRINTED CIRCUITS ON PLASTIC PANELS

(75) Inventors: Keith D. Weiss, Fenton, MI (US); Yana Shvartsman, Southfield, MI (US)

(73) Assignee: Exatec, LLC, Wixon, MI (US)

( * ) Notice: Subject to any disclaimer, the term of this patent is extended or adjusted under 35 U.S.C. 154(b) by 165 days.

(21) Appl. No.: 11/645,851

(22) Filed: Dec. 27, 2006

(65) Prior Publication Data

US 2007/0187391 A1 Aug. 16, 2007

Related U.S. Application Data

(60) Provisional application No. 60/754,966, filed on Dec. 29, 2005.

(51) Int. Cl.
*H05B 3/06* (2006.01)
*H05B 1/00* (2006.01)

(52) U.S. Cl. ..... 219/522; 219/214; 219/218; 219/219; 219/202; 219/203

(58) Field of Classification Search ..... 219/522, 219/218–219, 202–203, 214
See application file for complete search history.

(56) References Cited

U.S. PATENT DOCUMENTS 5,391,861 A * 2/1995 Ooyama et al. ..... 219/543

FOREIGN PATENT DOCUMENTS

GB 206 1680 A 11/1923

OTHER PUBLICATIONS

International Search Report—PCT/US2006/062613 (mailed May 15, 2007).

* cited by examiner

*Primary Examiner*—Shawntina Fuqua
(74) *Attorney, Agent, or Firm*—Cantor Colburn LLP

(57) ABSTRACT

A system for effectively defrosting a plastic window includes a transparent plastic panel, a heater grid having a plurality of grid lines that are integrally formed with the plastic panel, and equalizing means for equalizing the electrical current traveling through each of the grid lines.

9 Claims, 9 Drawing Sheets

ELECTRICAL CONNECTION TO PRINTED CIRCUITS ON PLASTIC PANELS

CROSS-REFERENCE TO RELATED APPLICATIONS

This application claims the benefit of U.S. Provisional Application Ser. No. 60/754,966 filed on Dec. 29, 2005, entitled "ELECTRICAL CONNECTION TO PRINTED CIRCUITS ON PLASTIC PANELS", the entire contents of which are incorporated herein by reference.

BACKGROUND

1. Field of the Invention

This invention relates to a conductive heater grid for use in defrosting plastic and glass panels, such as windows in vehicles.

2. Related Technology

Plastic materials, such as polycarbonate (PC) and polymethylmethyacrylate (PMMA), are currently being used in the manufacturing of numerous automotive parts and components, such as B-pillars, headlamps, and sunroofs. Automotive rear window (backlight) systems represent an application for these plastic materials due to their many identified advantages, particularly in the areas of styling/design, weight savings, and safety/security. More specifically, plastic materials offer the automotive manufacturer the ability to reduce the complexity of the rear window assembly through the integration of functional components into the molded plastic system, as well as the ability to distinguish their vehicles by increasing overall design and shape complexity. Being lighter in weight than conventional glass backlight systems, their incorporation into the vehicle may facilitate both a lower center of gravity for the vehicle (and therefore better vehicle handling & safety) and improved fuel economy. Further, enhanced safety is realized, particularly in a roll-over accident because of a greater probability of the occupant or passenger being retained in a vehicle.

In order to be used as a rear window or backlight on a vehicle, the plastic material must be compatible with the use of a defroster or defogging system, better known as a heater grid. For commercial acceptance, a plastic backlight must meet the performance criteria established for the defrosting or defogging of glass backlights. One difference between glass and plastics panels is related to the electrical conductivity exhibited by the heater grid. This difference in conductivity manifests itself in poor defrosting characteristics exhibited by the plastic window, as compared to the glass window. This difference in conductivity manifests itself in the inefficient heating of portions of the defroster, such as the busbar, that provides very little to no benefit to defrosting the overall window.

In addition to the previously mentioned drawbacks, the amount of electrical current traveling through each of the grid lines of the heater grid may vary. This variance causes grid lines with a less restrictive conductive path to heat up faster, leaving both defrosted and frosted portions of the plastic panels.

Therefore, there is a need for a system that will effectively defrost a plastic window with performance characteristics similar to that of a conventional glass window.

SUMMARY

In satisfying the above need, as well as overcoming the enumerated drawbacks and other limitations of the known technology, the present invention provides a system that effectively defrosts a plastic window with performance characteristics similar to that of a conventional glass window. The system includes a transparent plastic panel, a heater grid having a plurality of grid lines that are integrally formed with the plastic panel, and equalizing means for equalizing the amount of electrical current traveling trough each of the grid lines.

The equalizing means typically includes a first and second busbar connected to positive and negative terminals, respectively, of a power supply. The plurality of grid lines extend between the first and second busbars. In order to equalize the current traveling through the grid lines, the busbars may be made of a material that is more conductive than the material used to make the grid lines. Additionally or alternatively, the busbars may be made thicker than the grid lines, thereby allowing current to travel more freely from the power supply to the grid lines.

The equalizing means may also include additional highly conductive material placed along the lengths of the busbars. By so doing, current will travel more freely from the power supply to the grid lines, thereby equalizing the current traveling through the grid lines. This highly conductive material may be in the form of a metallic insert or may be a portion of a metallic tape.

Finally, the equalizing means may also include a plurality of connections on each busbar to the power supply. By having a plurality of connections to the busbars, current is more equally distributed to the busbars, resulting in a more equal distribution in the current traveling through the grid lines.

Further objects, features and advantages of this invention will become readily apparent to persons skilled in the art after a review of the following description, with reference to the drawings and claims that are appended to and form a part of this specification.

DETAILED DESCRIPTION

Figure 1:
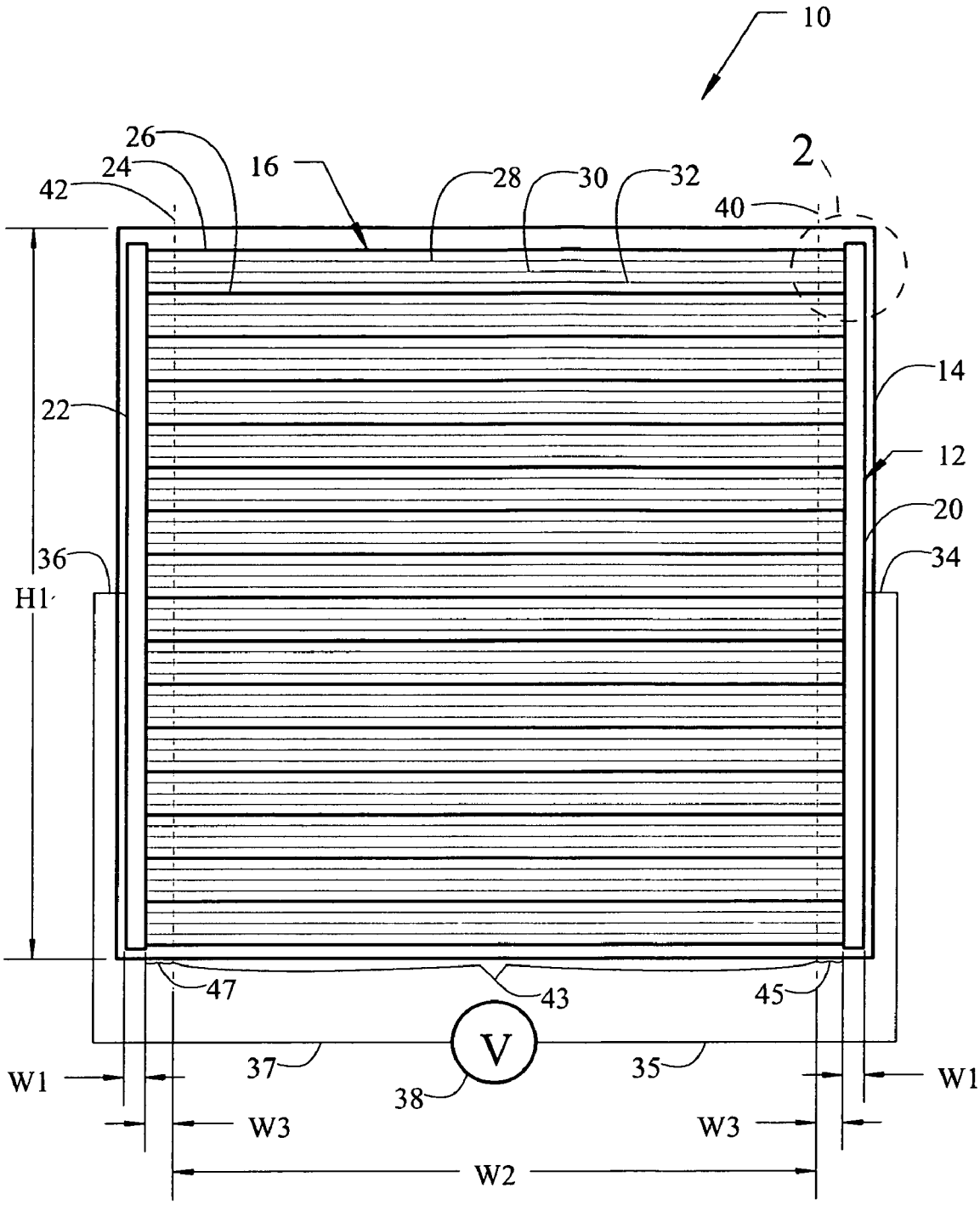
FIG. 1 is a plastic window assembly incorporating a defrosting grid with busbars embodying the principles of the present invention.

Referring to FIG. 1, window defroster assembly 10 generally includes a defroster 12 provided on a panel 14. The panel 14 may be made of a thermoplastic resin including, but not limited to, polycarbonate resins, acrylic resins, polyarylate resins, polyester resins, and polysulfone resins, as well as copolymers and any combination thereof. Preferably, the panel 14 is transparent. The panel 14 may further comprise a protective coating system that lies on the surface of the thermoplastic resin and upon which the defroster 12 is applied. The protective coating system may comprise a weather resistant coating, an abrasion resistant coating, or both. An example of a panel 14 that comprises a plastic resin, a weather resistant coating, and an abrasion resistant coating upon which a defroster can be applied is the Exatec® 900 glazing system. This glazing system comprises a polycarbonate resin, an SHP9X & SHX weather resistant coating, and a glass-like abrasion resistant coating.

The defroster 12 includes a heater grid 16 having a series of grid lines extending between generally opposed busbars 20, 22. The heater grid may include grid lines of the same dimensions or it may include major grid lines 24, 26 with minor grid lines 28, 30, 32 located there between. The major and minor grid lines 24, 26, 28, 30, 32 are described in U.S. Pat. No. 7,129,444, the entirety of which is hereby incorporated by reference.

While illustrated with three minor grid lines, it should be understood that there may be any number of minor grid lines between the major grid lines 24, 26. Furthermore, the minor grid lines 28, 30, 32 may be replaced by a conductive film or coating between the major grid lines 24, 26. In this illustrated embodiment, the heater grid 16 includes seventeen major grid lines and forty-eight minor grid lines. The present invention contemplates additional major and/or minor grid lines. The major grid lines 24, 26 and minor grid lines 28, 30, 32 may be made of a conductive ink, such as silver ink.

The busbars 20, 22 are respectively designated as positive and negative busbars. The busbars 20, 22 have electrical connectors 34, 36 and are connected respectively to positive and negative leads 35, 37 of a power supply 38. The power supply 38 may be the electrical system of an automobile vehicle. Upon the application of a voltage across the heater grid 16, current will flow through the grid lines 16, from the positive busbar 20 to the negative busbar 22 and, as a result, the grid lines 16 will heat up via resistive heating. In this type of design, it has been observed that the major grid lines 24, 26 exhibit a temperature between 10-15° C. higher than the minor grid lines 28, 30, 32.

In one embodiment, the busbars 20, 22 generally have a width W1 of about 19 mm and have a length H1 of about 704 mm. However, width W1 and length H1 may be any suitable dimension. Reference lines 40 and 42 divide the heater grid 16 into a first zone 43, a second zone 45 and a third zone 47. The first zone 42 is the portion of the heater grid 16 between the lines 40, 42. The second zone 45 is the portion of the heater grid 16 between reference line 40 and the right busbar 20. Finally, the third zone 47 is the portion of the heater grid 16 between reference line 42 and the left busbar 22. In the above implementation, zone 43 has a length W2 of about 650 mm, while the second and third zones 45, 47 have lengths W3 of about 27 mm. It should be understood that width W2 and width W3 may be any suitable dimension. In the first zone 43, the major grid lines 24, 26 and minor grid lines 28, 30, 32 may have a width of about 0.85 mm and 0.25 mm, respectively. In the second and third zones 45, 47, the major grid lines 24, 26 and minor grid lines 28, 30, 32 may have a width of about 2.00 mm and 0.40 mm, respectively. Of course, the width of the major grid lines 24, 26 and minor grid lines 28, 30, 32 may be any suitable dimension.

Figure 2:
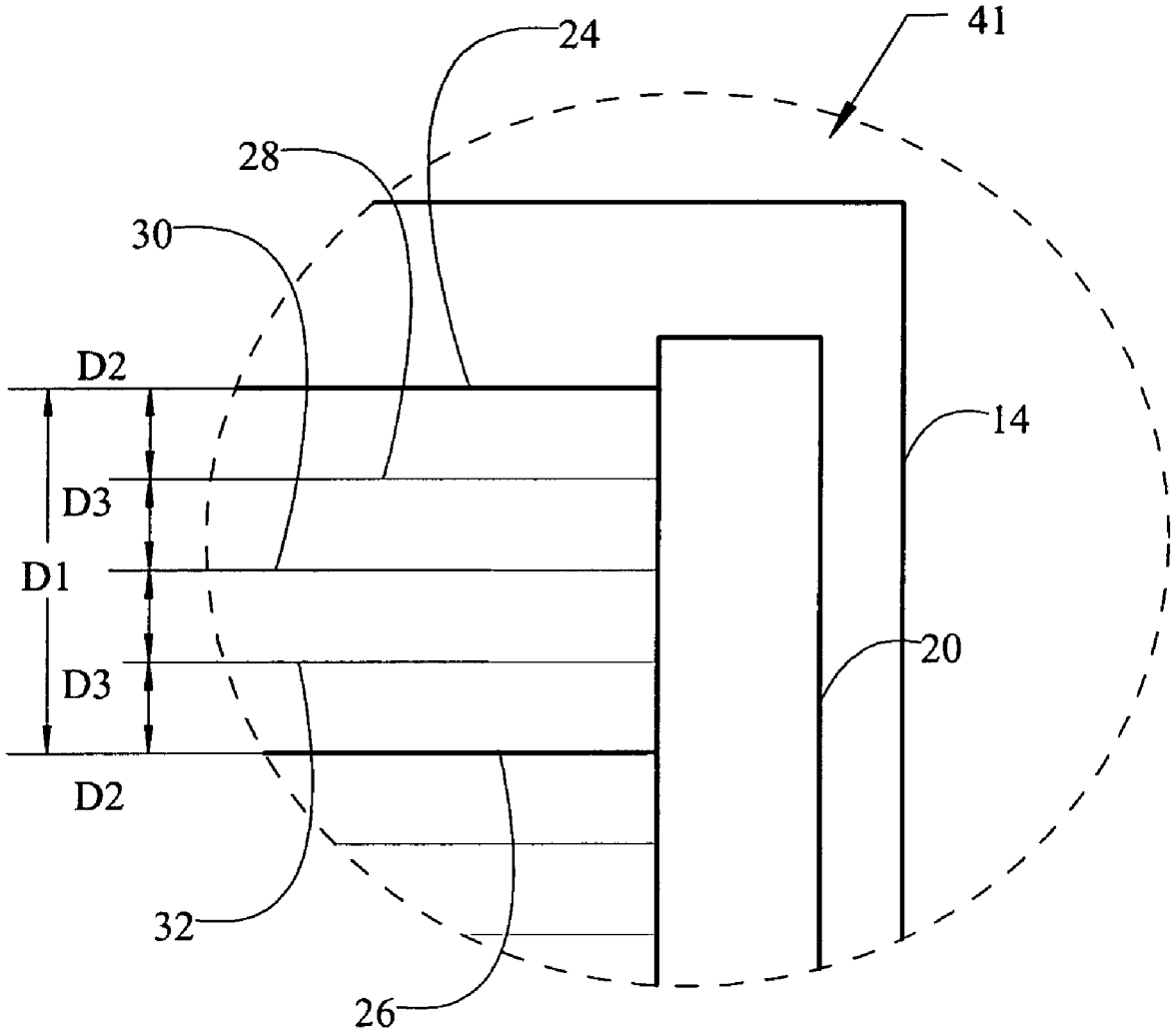
FIG. 2 is a more detailed view of a portion of the window assembly of FIG. 1.

Referring to FIGS. 1 and 2, the further dimensions of the heater grid 16 are shown. FIG. 2 is a close up view of a portion of the window defroster assembly 10 as with the reference circle 41. The distance D1 between the major grid lines 24, 26 may be about 25 mm. The distance D2 between minor grid lines 28, 32 and major grid lines 24, 26 may be about 13.5 mm. The distance D3 between minor grid lines 28, 32 and minor grid line 30 may be about 8.5 mm. Of course, the distances D1, D2 and D3 may be any suitable dimension.

The resistive heating of a busbars 20, 22 is highly dependent upon the amount of electrical voltage applied and the volume of conductive ink through which the electrical current flows. Thus, increasing the volume of conductive ink by adding additional conductive ink to the busbars 20, 22 through a second printing process, decreases the resistive heating of the busbars 20, 22. The volume of conductive ink deposited during the initial printing of the entire heater grid 16 can also be increased in the busbars 20, 22. Volume control by the use of various techniques is generally known to screen printing manufacturers. This technique can increase the emulsion thickness on the screen localized around busbars 20, 22, thereby increasing the print thickness of the busbars 20, 22 in comparison to the print thickness of the heater grid 16. Other printing techniques, such as dispensing, can increase the amount of ink deposited, and thus the volume for each busbar by controlling printing parameters, such as flow rate, transverse speed, etc.

Another way of reducing the resistive heating of the busbars 20, 22 is to make the busbars 20, 22 out of a different material than the heater grid 16. More specifically, this different material should exhibit a conductivity that is greater than the conductivity associated with the heater grid 16. In this respect, busbars 20, 22 could be made of a metallic tape or a metallic insert. The conductive tape or panel may be positioned underneath or on top of the heater grid 16 in order to establish sufficient electrical connection between the busbars 20, 22 and the heater grid 16. The metallic tape or panel can be attached to the panel 14 after the panel 14 is formed through the use of an adhesive or during the forming of the window as an insert (e.g., film insert molding, etc.).

Figure 3:
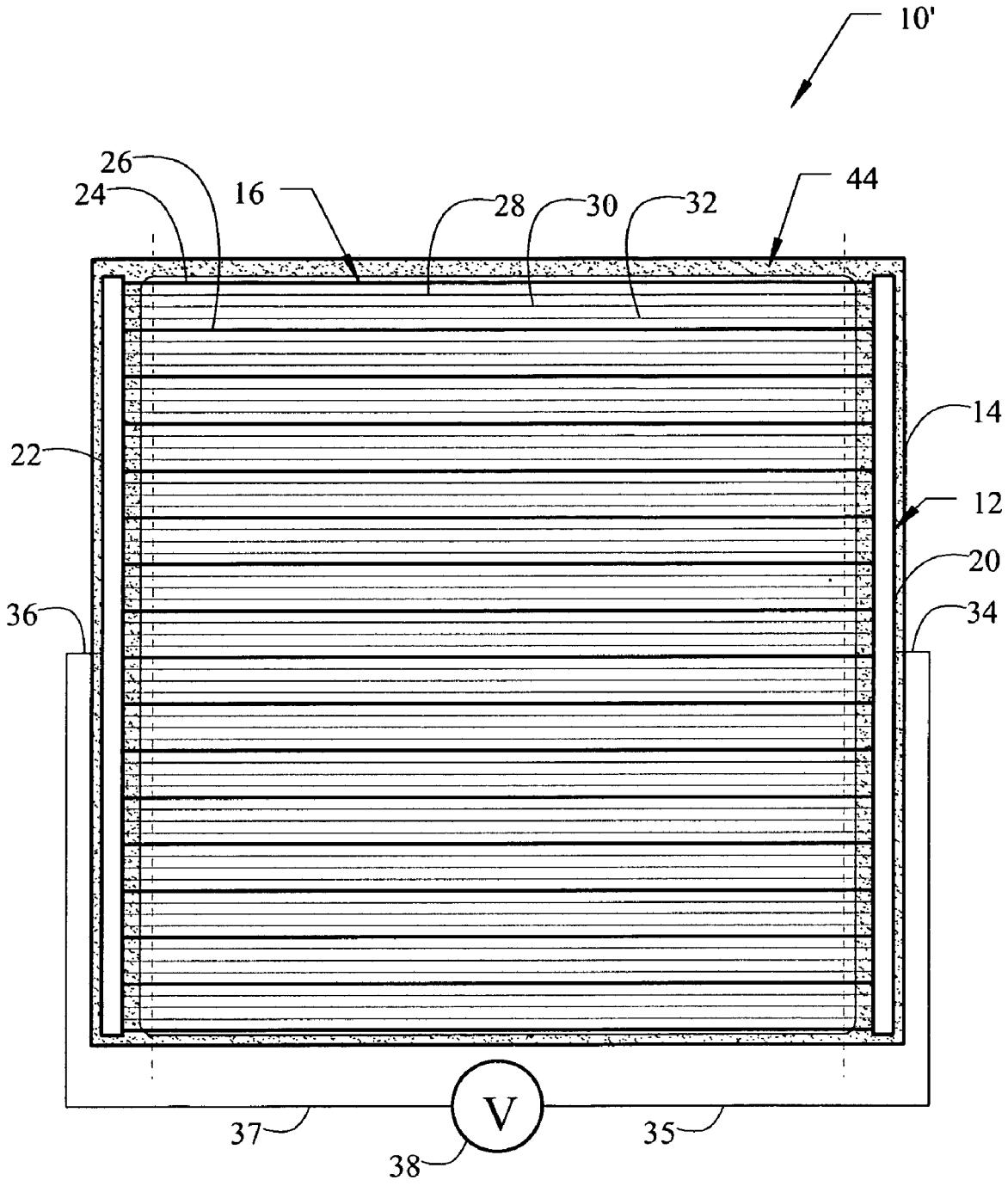
FIG. 3 is a plastic window assembly similar to FIG. 1 having a black out ink border.

Referring to FIG. 3 another embodiment of the window defroster assembly 10' is shown. The window defroster assembly 10' is similar to the embodiment shown in FIG. 1; however, the window defroster assembly 10' further includes areas of opacity, such as a black-out border 44. Such borders 44 are typically used for aesthetic reasons, such as masking fit and finish imperfections and concealing mounting structures or functional components such as the busbars 20, 22. The blackout border 44 can be applied to the panel 14 by printing an opaque ink onto the surface of the panel 14 or through the use of known in mold decorating techniques, including insert film molding.

Figure 4:
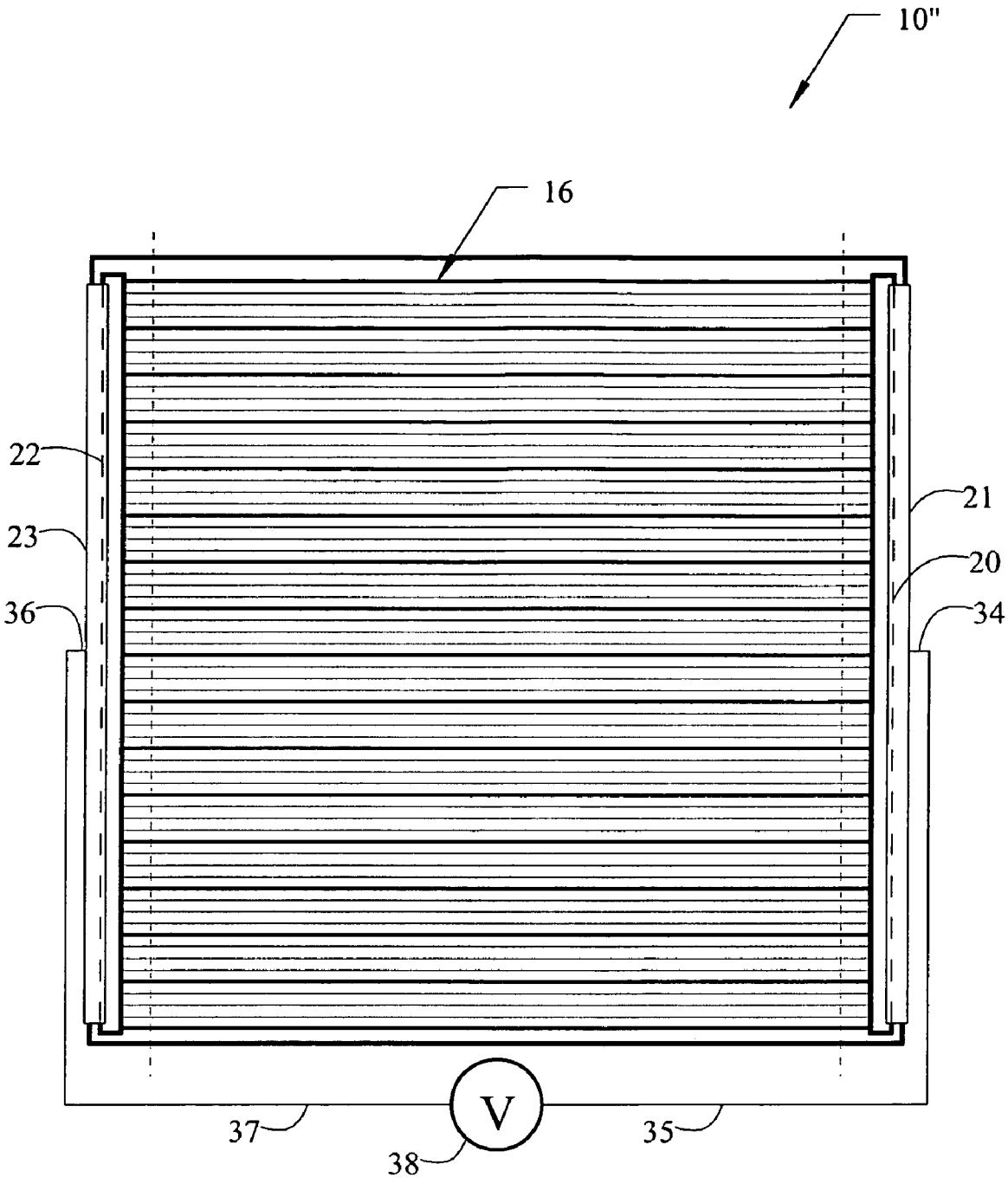
FIG. 4 is a plastic window assembly similar to FIG. 1 having conductive strips along a portion of the length of the busbars embodying the principles of the present invention.

Referring to FIG. 4 another embodiment of the window defroster assembly 10" is shown. This embodiment is similar to the embodiment illustrated in FIG. 1; however, conductive inserts 21, 23 are in electrical communication with busbars 20, 22, respectively. Generally, the conductive inserts 21, 23 run along at least a portion of the length of the busbars 20, 22. The electrical connectors 34, 36 are connected to conductive inserts 21, 23, respectively. The electrical connectors 34, 36 are also connected to positive and negative leads 35, 37 of a power supply 38, thereby providing a voltage to the busbars 20, 22 via the conductive inserts 21, 23, respectively. Generally, the conductive inserts 21, 23 are highly conductive and may be a conductive metallic tape or highly conductive trace.

As further discussed below, the use of conductive inserts may reduce the temperature of the busbars 20, 22 as a voltage is applied to the heater grid 16 via the busbars 20, 22. In other words, for two electrical connectors spaced 5 inches apart is equivalent to using one electrical connection to a 5 inch metallic insert or tape positioned on the printed busbar.

Figure 5:
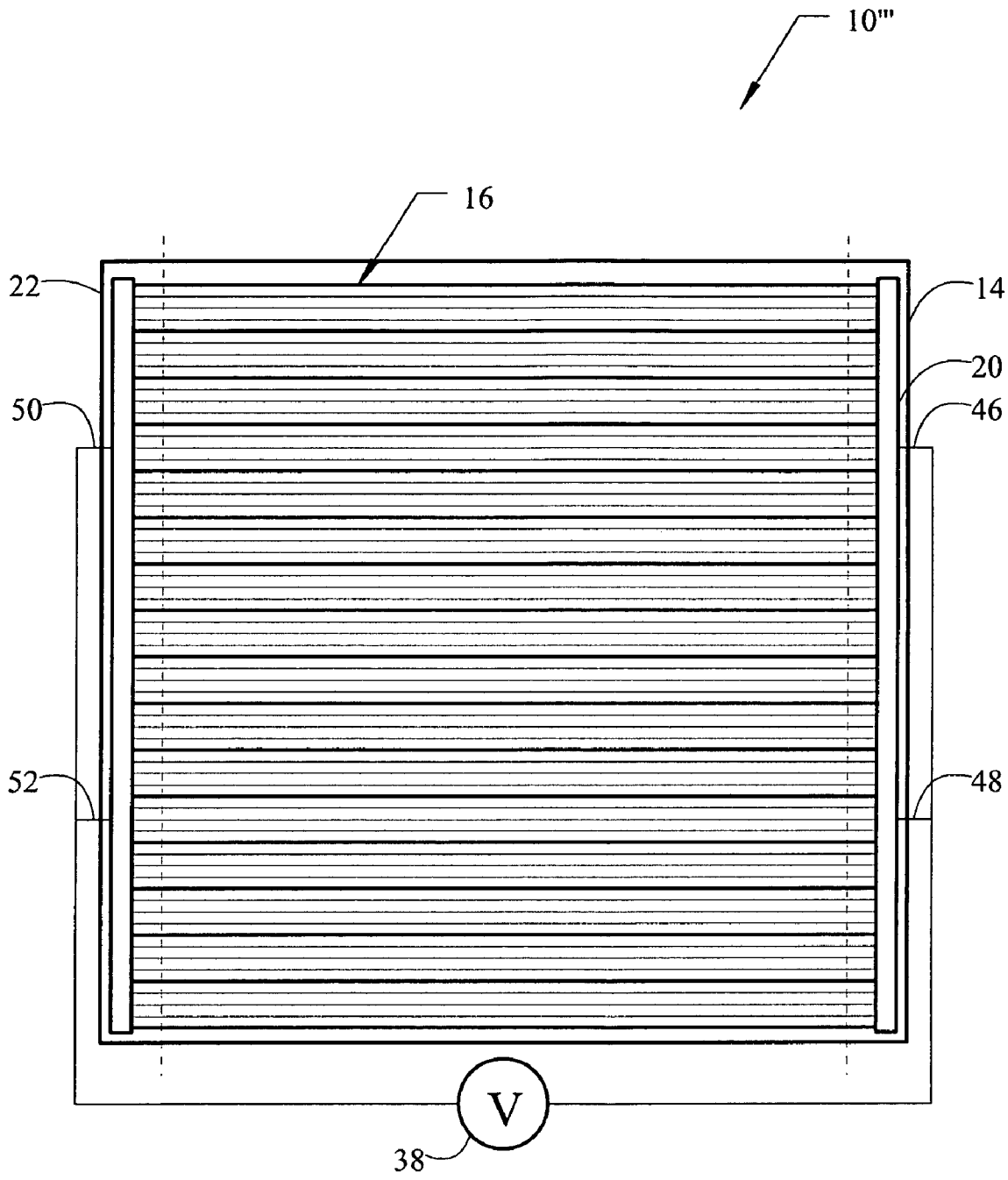
FIG. 5 is a plastic window assembly similar to FIG. 1 having more than one electrical connection per busbar embodying the principles of the present invention.

Referring to FIG. 5 another embodiment of the window defroster assembly 10''' is shown. The window defroster assembly 10''' is similar to the embodiment shown in FIG. 1; however, the busbars 20, 22 are connected in a different manner to the power supply 38. More specifically, the assembly 10''', the busbars 20, 22 are each connected to power supply 38 thorough at least two connections. For example, a pair of electrical connectors 46, 48 and electrical connectors 50, 52, are connected to busbars 20 and 22, respectively. Of course, the present invention contemplates additional electrical connectors.

Figure 6:
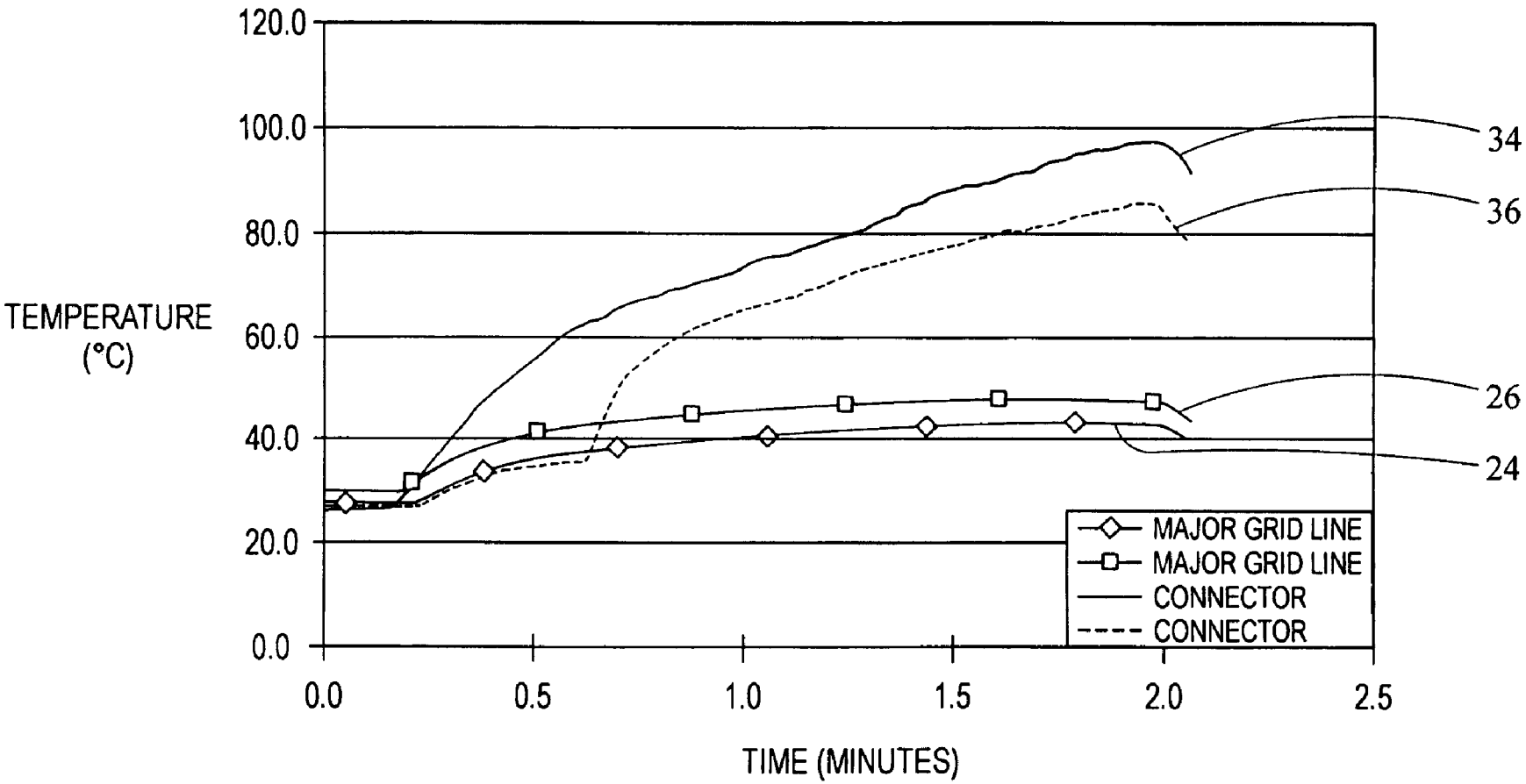
FIG. 6 is a chart showing the temperature profile of busbars and grid lines of a heater grid with one electrical connection per busbar.

Referring to FIG. 6, a chart displaying the temperature profile of the busbars with one electrical connector per busbar is shown. The inventors have discovered that one electrical connection per busbar 34, 36 as shown in FIG. 1, printed on the panel 14 through the use of a conductive ink will cause the busbars 34, 36 to significantly increase in temperature. The single electrical connectors on busbars present in the heater grid is seen to increase in temperature within several minutes to about 80-100° C. In the chart shown in FIG. 6, busbars 34, 36 with one electrical connection are observed to exhibit a greater amount of resistive heating than the major grid lines 24, 26 grid lines in the associated heater grid. The grid lines are shown to exhibit a temperature of between 40-50° C. The resistive heating of the busbars is observed to occur either over the entire length of the busbars to certain portions of the busbars or localized to an area near the electrical connectors.

Figure 7:
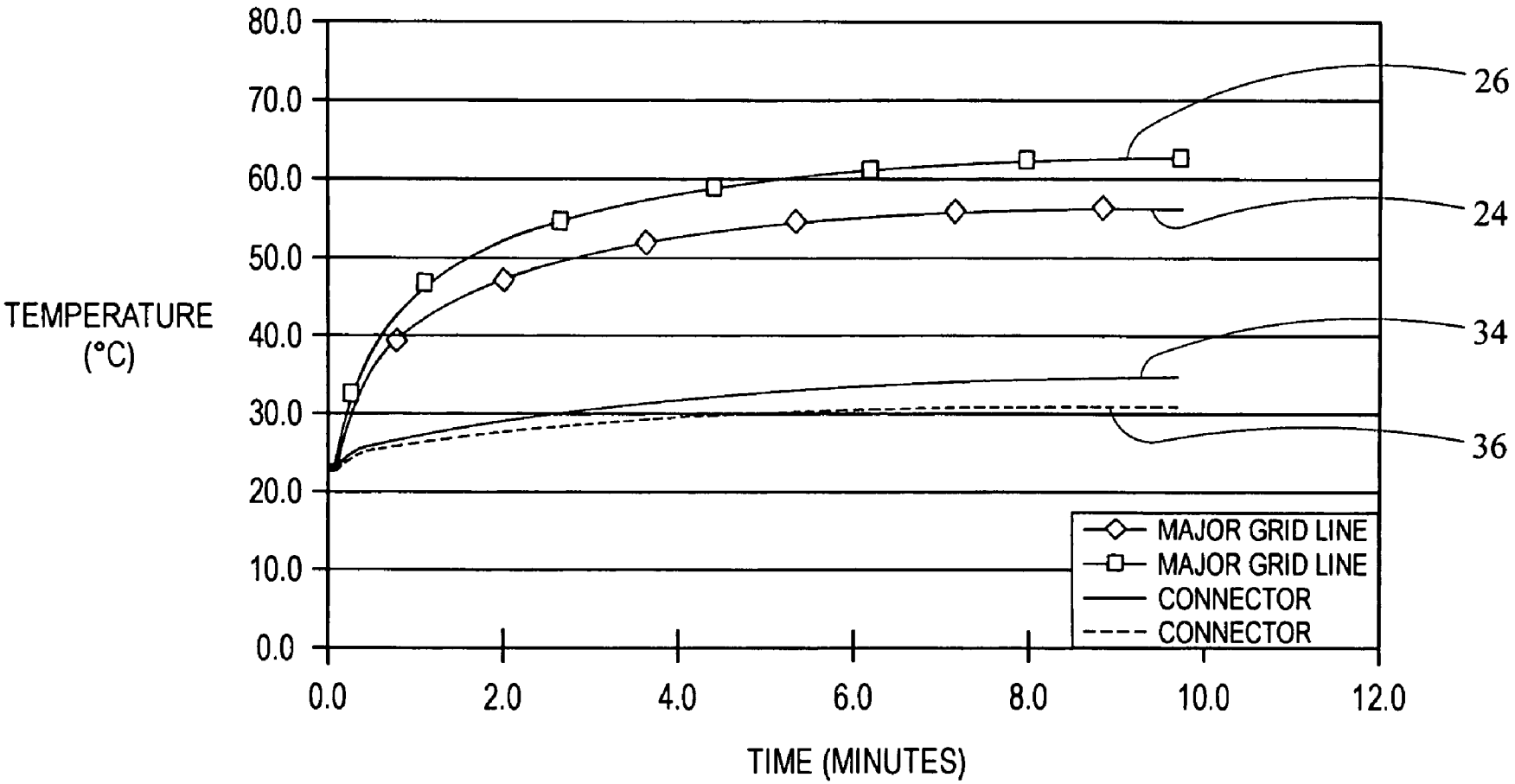
FIG. 7 illustrates the temperature profile of busbars and grid lines of a heater grid with two electrical connections per busbar.

Referring to FIG. 7, a chart displaying the temperature profile of the busbars with two electrical connections per busbar, such as shown in FIG. 5, is shown. The heater grid 16 having busbars with two electrical connectors 34, 36 per busbar was tested. The electrical connectors on each of the busbars were spaced about 6 inches apart from each other. With this construction, the busbars 20, 24 were found to exhibit very little resistive heating, stabilizing at a temperature of about 40° C., while the major grid lines 24, 26 were observed to heat to 60-70° C.

Figure 8:
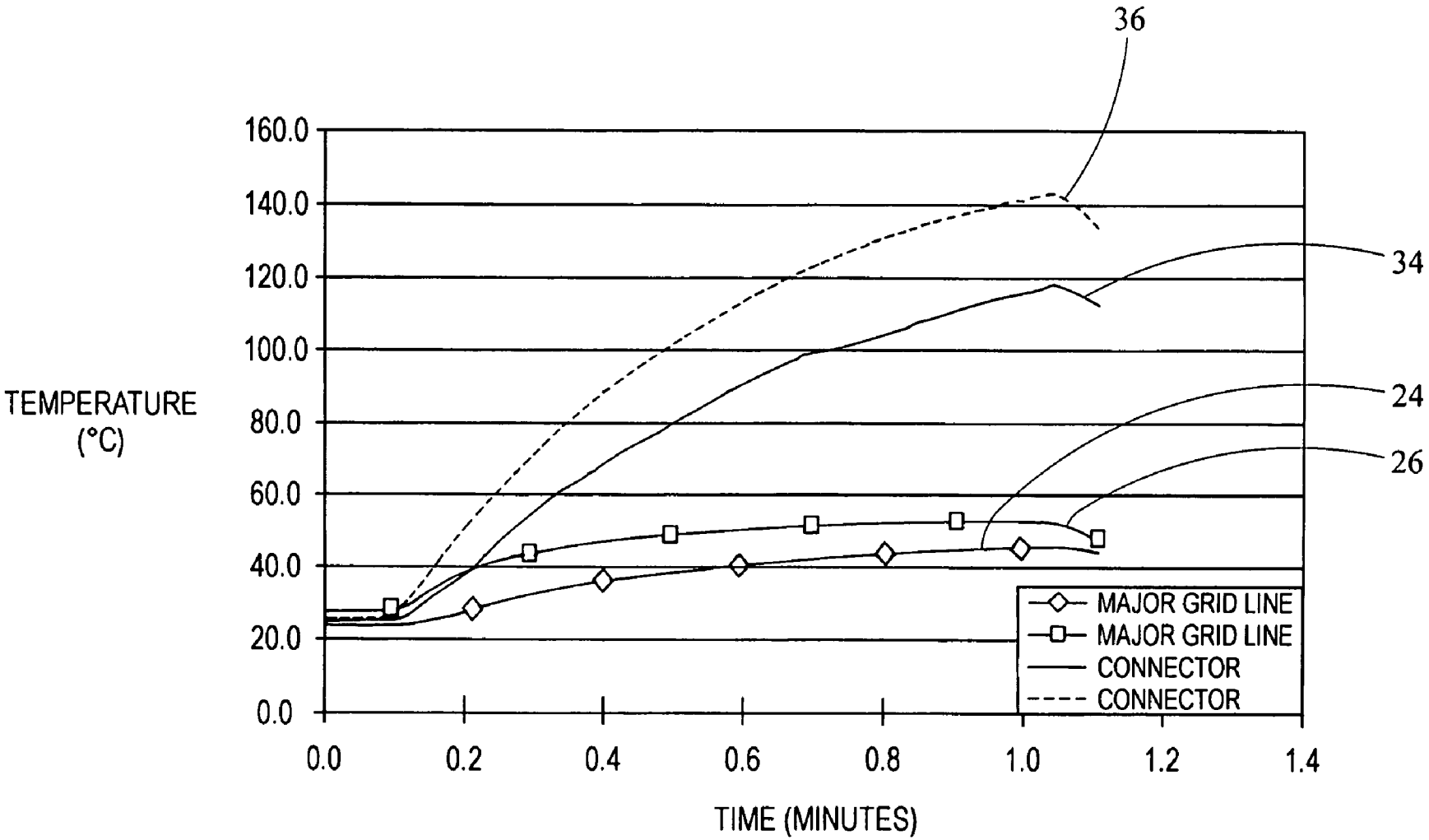
FIG. 8 illustrates the temperature profile of busbars and grid lines of a heater grid with one electrical connection per busbar.
Figure 9:
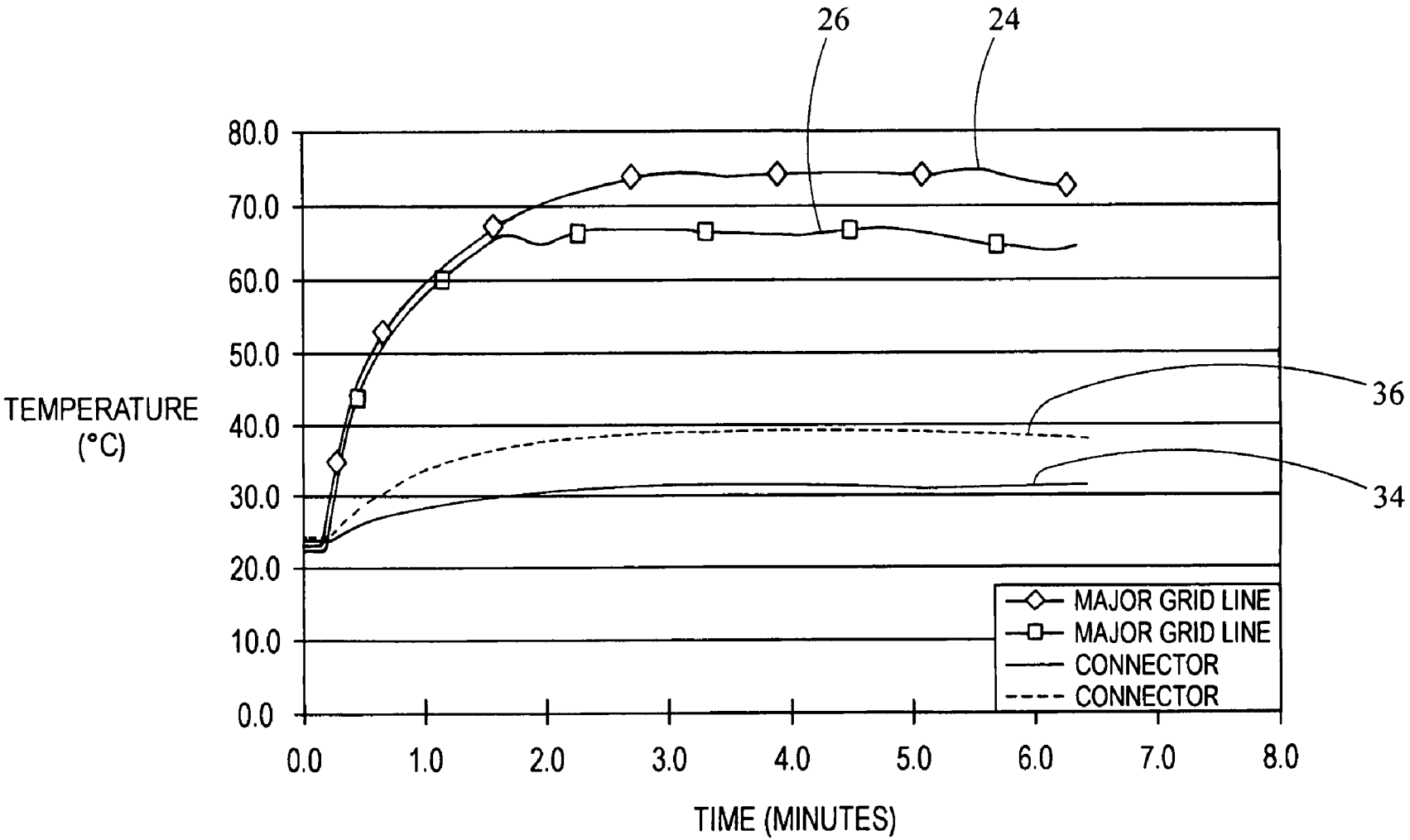
FIG. 9 illustrates the temperature profile of busbars and grid lines of a heater grid with two electrical connections per busbar.

Referring to FIGS. 8 and 9, the same effect is observed to occur, if the heater grid 16 is printed onto a thin film of plastic and then insert molded into a window. As shown in FIGS. 8 and 9, one connection to each busbar causes a different heating of the busbar (FIG. 8), while two connections per busbar allows the heater grid to function as designed (FIG. 9).

The inventors have discovered that the average temperature of the busbar can be sustained below the average temperature of the grid lines when the electrical connections to each busbar in a defroster printed on a plastic panel are provided at about three inches (74 mm) apart. However, when the electrical connectors are in this close position, there will still be some localized heating of the busbar in that the maximum temperature exhibited by the busbar is above the average temperature exhibited by the grid lines. Thus, it is preferred that the electrical connectors be positioned more than three inches apart and more preferably about five inches (125 mm) or greater apart. In this case, the average and maximum temperature exhibited by the busbar will be equal to or less than the average temperature exhibited by the grid lines.

The inventors have further discovered that greater than about five inches (125 mm) spacing between the electrical connectors is necessary for a defroster printed on a thin sheet and incorporated into a window via film insert molding (FIM). As shown in Table 1, the spacing of greater than five inches is necessary to ensure that the average and maximum temperatures exhibited by the busbars are equal to or less than the average temperature exhibited by the grid lines when voltage is applied to the defroster.

TABLE 1

| | Connections/busbar | | Distance | Time | Temperature (° C.) Grid lines | | | Connections | | |
|---|---|---|---|---|---|---|---|---|---|---|
| Trial | # | Location | (mm) | (minutes) | Min | Max | Average | Min | Max | Average |
| | | | | IMD design printed on 730 PC plaque: | | | | | | |
| 1 | 1 | Center | | 10 | 55 | 62 | 58.5 | 72 | 78 | 75 |
| 2 | 1 | Diagonally (Top left to bottom right) | | 2 | 44 | 45 | 44.5 | 85 | 113 | 99 |
| 3 | 2 | Lines 7-8 and 8-9 | 44 | 10 | 57 | 60 | 58.5 | 65 | 75 | 70 |
| 4 | 2 | | 74 | 10 | 55 | 58 | 56.5 | 27 | 71.7 | 49.35 |
| 5 | 2 | | 100 | 10 | 53 | 68 | 60.5 | 27 | 74 | 50.5 |
| 6 | 2 | Lines 6-7 and 9-10 | 132 | 10 | 56 | 68 | 62 | 31 | 61 | 46 |
| 7 | 2 | Lines 5-6 and 10-11 | 220 | 10 | 57 | 64 | 60.5 | 30 | 51 | 40.5 |
| | | | | IMD film | | | | | | |
| 1 | 1 | Center | | 2 | 44 | 67 | 55.5 | 83 | 99 | 91 |
| 2 | 1 | Diagonally (Top left to bottom right) | | 2 | | low 30s | | | >100 | |
| 3 | 2 | Lines 7-8 and 8-9 | 44 | 2 | 59 | 63 | 61 | 80 | 92 | 86 |
| 4 | 2 | Lines 6-7 and 9-10 | 132 | 10 | 55 | 60 | 57.5 | 67 | 76 | 71.5 |
| 5 | 2 | Lines 5-6 and 10-11 | 220 | 5 | 62 | 68 | 65 | 49 | 60 | 54.5 |

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

The invention claimed is:

1. A window defroster assembly comprising:

a transparent plastic panel;

a heater grid integrally formed with the plastic panel, the heater grid having a plurality of grid lines formed of a conductive material, whereby the plurality of grid lines heat via resistive heating when an electrical current from a power supply travels through each of the plurality of grid lines; and a means for equalizing the electrical current traveling through each of the grid lines, the means for equalizing being electrically connected to the plurality of grid lines, wherein the means comprises:

a first busbar and a second busbar, the plurality of grid lines extending between the first and second busbars, the first and second busbars being made of a conductive material;

a first metallic insert in electrical communication with the power supply and the first busbar, the first metallic insert being made of a conductive material that is more conductive than the conductive material of the first busbar; and a second metallic insert in electrical communication with the power supply and the second busbar, the second metallic insert being made of a conductive material that is more conductive than the conductive material of the second busbar.

2. The window assembly of claim 1, wherein the first and second busbars are substantially equal in length and the first and second metallic inserts are substantially equal in length, the length of the first and second metallic inserts being less than the length of the first and second busbars.

3. The window assembly of claim 2, wherein the lengths of the first and second metallic inserts are more than half the length of the first and second busbars.

4. A window defroster assembly comprising:

a transparent plastic panel;

a heater grid integrally formed with the plastic panel, the heater grid having a plurality of grid lines formed of a conductive material, whereby the plurality of grid lines heat via resistive heating when an electrical current from a power supply travels through each of the plurality of grid lines; and a means for equalizing the electrical current traveling through each of the grid lines, the means for equalizing being electrically connected to the plurality of grid lines, wherein the means for equalizing comprises:

a first busbar and a second busbar, the plurality of grid lines extending between the first and second busbars, the first and second busbars being made of a conductive material; and a first metallic tape portion being in electrical communication with the power supply and the first busbar, the first metallic tape being made of a conductive material that is more conductive than the conductive material of the first busbar; and a second metallic tape portion being in electrical communication with the power supply and the second busbar, the second metallic tape being made of a conductive material that is more conductive than the conductive material of the second busbar.

5. The window assembly of claim 4, wherein the first and second busbars are substantially equal in length and the first and second metallic tape portions are substantially equal in length, the length of the first and second metallic tape portions being less than the length of the first and second busbars.

6. The window assembly of claim 5, wherein the length of the first and second metallic tape portions are more than half the length of the first and second busbars.

7. A window defroster assembly comprising:

a transparent plastic panel;

a heater grid integrally formed with the plastic panel, the heater grid having a plurality of grid lines formed of a conductive material, whereby the plurality of grid lines heat via resistive heating when an electrical current from a power supply travels through each of the plurality of grid lines; and a means for equalizing the electrical current traveling through each of the grid lines, the means for equalizing being electrically connected to the plurality of grid lines, wherein the means for equalizing comprises:

a first busbar and a second busbar, the plurality of grid lines extending between the first and second busbars, wherein the first and second busbars define a length, width and thickness, the thickness of the busbars being greater than the thickness of the plurality of grid lines.

8. A window defroster assembly comprising:

a transparent plastic panel;

a heater grid integrally formed with the plastic panel, the heater grid having a plurality of grid lines formed of a conductive material, whereby the plurality of grid lines heat via resistive heating when an electrical current from a power supply travels through each of the plurality of grid lines; and a means for equalizing the electrical current traveling through each of the grid lines, the means for equalizing being electrically connected to the plurality of grid lines;

wherein the means for equalizing comprises:

a first busbar and a second busbar, the plurality of grid lines extending between the first and second busbars;

a plurality of connections to each of the first busbar and a second busbar; the plurality of connections being in electrical communication with the power supply and the first and second busbars; and wherein the plurality of connections to each of the first and second busbars are spaced at least 3 inches apart.

9. The window assembly of claim 8, wherein the plurality of connections to each of the first and second busbars are spaced about 5 inches apart.

* * * * *